United States Patent [19]

Ullman

[11] Patent Number: 4,919,281

[45] Date of Patent: Apr. 24, 1990

[54] FABRIC BOLT HANGER

[75] Inventor: Myron Ullman, Canfield, Ohio

[73] Assignee: Boardman Molded Products, Inc., Youngstown, Ohio

[21] Appl. No.: 283,384

[22] Filed: Dec. 8, 1988

[51] Int. Cl.[5] ..... A47F 5/08

[52] U.S. Cl. ..... 211/116; 211/118

[58] Field of Search ..... 211/116, 118, 125, 13, 211/73; 248/174, 454

[56] References Cited

U.S. PATENT DOCUMENTS

| | | | |
|---|---|---|---|
| 2,271,941 | 2/1942 | Kemmith | 211/118 |
| 2,290,540 | 7/1942 | Cornetto | 211/118 |
| 2,469,481 | 5/1949 | Snyder | 211/118 |
| 2,535,625 | 12/1950 | Corwin | 211/118 |
| 2,675,130 | 4/1954 | Dore | 211/118 |
| 2,787,379 | 4/1957 | Fritz et al. | 211/118 X |
| 4,768,657 | 9/1988 | Lonow | 211/118 X |

*Primary Examiner*—Alvin C. Chin-Shue
*Assistant Examiner*—Sarah A. Lechok
*Attorney, Agent, or Firm*—Browdy and Neimark

[57] ABSTRACT

A molded plastic rack for bolts of fabric is integrally molded in blank form and includes a frame structure including outer perimeter slender members forming a substantially rectangular support frame and secondary reinforcing members of circular construction interconnected with one another and lying within the outer perimeter members. A hanger hook, integrally molded as part of the blank and connected to the frame by means of severable portions, is removable from the blank and insertable in an appropriate hole and the top of the rack. A plurality of fabric holders are also integrally molded as part of the blank and are severable from their initial positions for subsequent attachment to the frame so that fabric can be hooked thereon.

9 Claims; 3 Drawing Sheets

FABRIC BOLT HANGER

FIELD OF THE INVENTION

The present invention relates to racks for bolts of fabric, and more particularly to a rack which facilitates the reception, storage and shipping of woven fabric in bolt form, as well as to a process for manufacturing and assembling such a rack.

BACKGROUND OF THE INVENTION

Various hangers have been used to hold bolts of fabric, and the most commonly used hangers are made of metal. Over a period of time, it has become well-recognized that such metal hangers suffer from numerous disadvantages. For example, metal racks require plating or painting to insure that the rack does not rust or otherwise oxidize so that fabric contacting oxidized areas of the rack does not become stained or soiled. Metal racks, which have a length and width great enough to accommodate large quantities of fabric, are quite heavy and expensive to manufacture. Metal racks which can accommodate such large quantities of fabric are desirably made of reinforced or strengthened members; otherwise the racks tend to become permanently deformed via bending.

Of course the more reinforcement needed for the rack, the greater the weight and shipping cost of the fabric which is typically shipped on the rack to the ultimate user. Where metal racks of a shorter length and width have been used, there is generally insufficient length in the rack to support the width of the bolt of fabric, and the bolt itself (rather than the rack) has a tendency to bend, fold or crease thereby resulting in damage to the fabric. In summary, the conventional metal racks are expensive to manufacture, are too heavy and thus increase shipping costs, and easily become permanently deformed thereby requiring early replacement.

SUMMARY OF THE INVENTION

It is therefore an object of the present invention to overcome deficiencies in the prior art, such as indicated above.

It is a further object of the invention to provide an improved hanger or rack for bolts of fabric which does not suffer from the disadvantages and drawbacks of the known and commonly used racks.

It is still a further object of the invention to provide for the improved storage and shipping of bolts of fabric, e.g. to provide less expensive and more reliable storage and shipping of fabric bolts supported on an improved hanger or rack.

Another object of the invention is to provide a hanger or rack for supporting bolts of fabric which is light in weight, rustproof, and is manufactured from a plastic material, such as polycarbonate or polypropylene, preferably by a process of injecting molding so that the hanger is formed with no sharp edges which could catch on or snag the fabric when supported by and stored on the hanger or rack.

Yet another object is to provide a rack that will be of a length sufficient to accommodate the greatest dimension of a bolt of fabric, i.e. the length or width, and which may include means for fastening the fabric to the bottom, as well as to the top, of the rack.

Still another object is to provide a substantially planar rack which is reinforced in the vertical and horizontal dimensions by means of internally positioned, collapse-resistant reinforcing members.

A still further object is to provide a fabric-supporting rack molded of a plastic material, wherein all structural support and reinforcement members, as well as fabric fastening means, are molded simultaneously as part of an integral single planar blank or molding. In this way, all parts necessary for assembly can be formed and provided at the same time, and shipped to the fabric maker in one piece without fear of missing, i.e. lost or misplaced, parts. Because the molded product before assembly constitutes a simple planar structure, it can be stored or shipped in a flat container at minimum cost and without fear of breakage.

These and other objects and the nature and advantages of the present invention will be more apparent from the following detailed description of embodiments taken in conjunction with the drawing, wherein:

DETAILED DESCRIPTION OF THE INVENTION

Figure 3D:
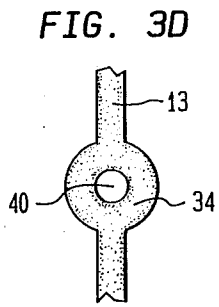
FIG. 3*d* is a view of the rack from above showing where the supporting hanger hook is inserted.
Figure 1:
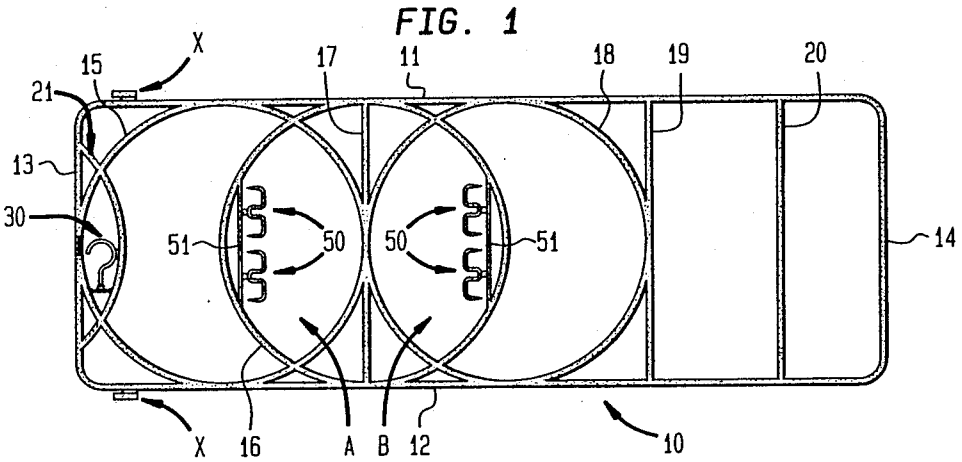
FIG. 1 shows an integral and substantially flat molding or blank from which the rack of the present invention is assembled, and illustrates the configurations and locations of the various elements which comprise the rack of the invention.

Referring now to the drawings, FIG. 1 shows a blank or molding 10 from which the rack of the present invention is assembled, as viewed from above, in which the planar, single-piece frame construction of the rack is illustrated subsequent to molding but prior to assembly. As shown, the rack comprises a rectangular frame which includes opposing, parallel side members 11, 12 and opposing, parallel head and foot members 13, 14. Disposed within the rectangular frame of the rack are reinforcement or strengthening members 15, 16, 17, 18, 19, 20, and 21. Reinforcement members 17, 19 and 20 interconnect side members 11, 12 and are substantially parallel to the head and foot members 13, 14.

Reinforcement members 15, 16 and 18 are circular members; all three of the circular members are interconnected, with reinforcement member 15 lying within rectangular region A of rack 10 (defined as the region between members 11, 12, 13 and 17), reinforcement member 18 lying within rectangular region B of rack 10 (defined as the region between members 11, 12, 17 and 19), and reinforcement member 16 having as its diameter member 17 and being interconnected with both reinforcing member 15 and 18 such that substantially identical nearly semicircular portions of member 16 are disposed in each of the rectangular regions A and B of the rack. Adjacent the head member 13 of the rack is the arcuate connecting member 21 provided primarily for the purpose of giving support to the correspondingly adjacent upper end of circular member 15. In this regard, it will be understood that the easily molded circular reinforcement members 15, 16 and 18 give excellent strength to the rack particularly against compressive collapse in any direction applied in the plane of the rack.

Figure 2:
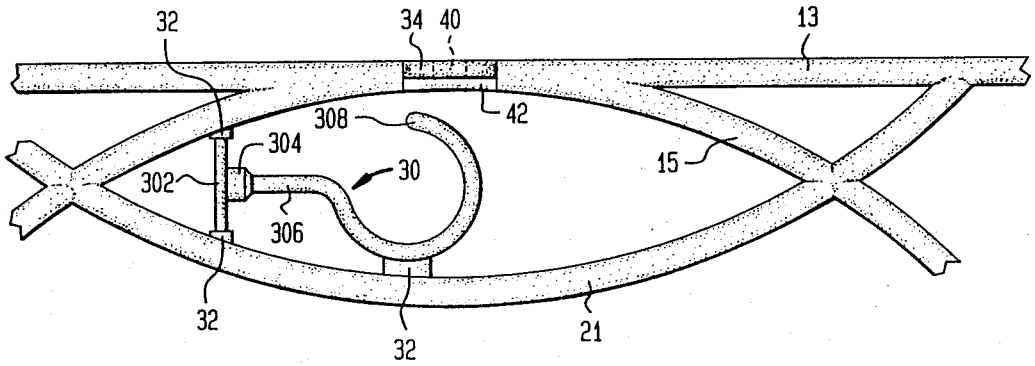
FIG. 2 is a detailed view of the upper portion of the unitary molding illustrating the rack supporting hanger hook, which is molded integrally with the rack, and the thin web members by which the hanger hook is initially attached to the rack structural reinforcement members.
Figure 3C:
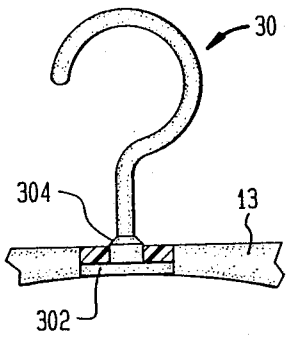
FIGS. 3*a*, 3*b* and 3*c* illustrate in a sequential step-by-step manner the insertion and anchoring of the rack supporting hanger hook in the opening provided in the rack head member.
Figure 3B:
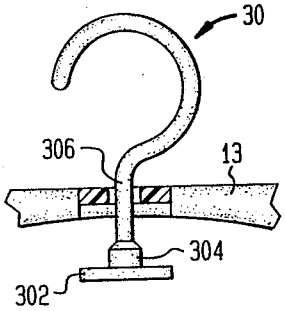
Figure 3A:
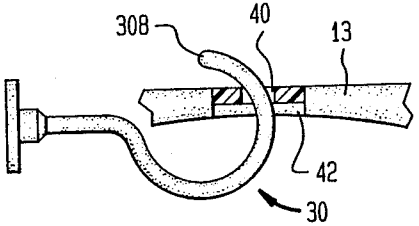

A hanger hook 30, molded along with the rack as part of the blank 10, is located between and appropriately temporarily connected via thin easily severed webs 32 to the arcuate connecting member 21 and the upper end of circular member 21 as shown in greater detail in FIG. 2. The hanger hook 30 includes a base 302 which may be a circular disc or merely a flat elongated piece, and a circular cylindrical support column 304 having a height of at least that of the thickness of the head member 13. The hanger hook 30, removed from the frame of the rack by severing or breaking the webs 32, is provided along with opening 40 defined by a circular portion 34 in the head member 13 for facilitating suspension of the rack from an appropriate upright support. To assemble the entire hanger hook 30 in the opening 40, it is necessary to first thread the free end 308 of the hanger hook through the opening 40 in the circular portion 34 as shown in FIG. 3*a*, then to thread the hook shank 306 through the opening as shown in FIG. 3*b*, and finally to frictionally anchor the hook column 304 in the hole 40. The base 302 may desirably fit, e.g. frictionally, in a recess 42 below the circular portion 34 or at least its ends may so frictionally fit.

Located desirably in the regions A and B of the molded blank 10 are fabric holders 50 temporarily connected by thin easily severed webs 54 to cross-pieces 51 supported at their ends by the circular reinforcement member 16, it being understood that other molding locations are also suitable. Two pairs of fabric holders 50 are provided although only one pair is needed, the second pair being provided as spares. The fabric holders 50 are removed from the blank 10 by severing or breaking the webs 54.

Figure 5:
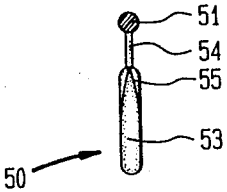
FIG. 5 is a side view of the fabric holder shown in FIG. 4.
Figure 4:
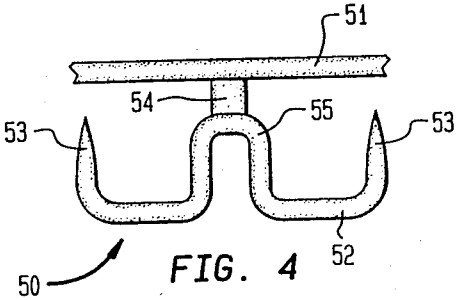
FIG. 4 is a front view of a fabric holder molded integrally with the blank and before separation for use with the rack of the present invention.

Each fabric holder 50 is as shown in FIGS. 4 and 5, having a double U configuration, and each includes a U-shaped central portion 55 and a pair of coaxial base bars 52 having piercing hooks 53 extending perpendicularly therefrom at opposite ends thereof. The base bars 52 function as a hook bar for supporting the piercing hooks 53.

After the fabric holders 50 have been detached from their respective reinforcement members, they are assembled to the frame structure of the rack at the locations designated "X " in FIG. 1. The locations "X" on each of the side members 11, 12 of rack 10 are identical in structure. Any one of the fabric holders 50 may be used with and secured to rack 10 at any one of the locations "X".

Figure 6:
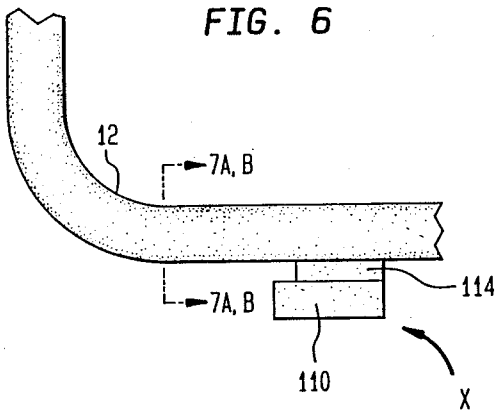
FIG. 6 is an enlarged view of one attachment location "X" shown in FIG. 1 to which the fabric holder of FIGS. 4–5 is attached.
Figure 7A:
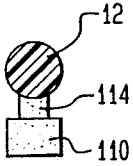
FIGS. 7A and 7B are top partially sectional views along line 7—7 in FIG. 6 of alternative embodiments.
Figure 7B:
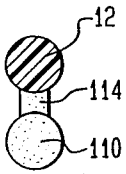
Figure 9A:
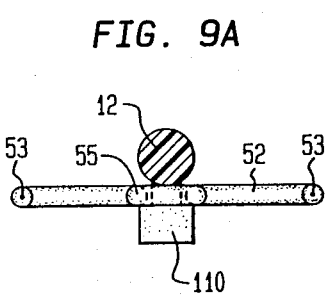
FIGS. 9A and 9B are top, partially sectional views of the construction of FIG. 8 using respectively the embodiments of FIGS. 7A and 7B.
Figure 9B:
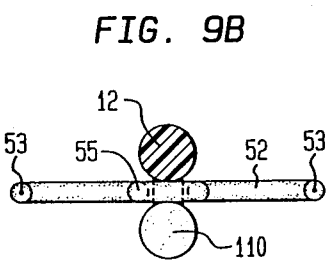
Figure 8:
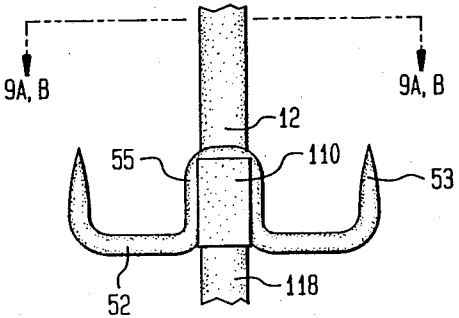
FIG. 8 shows the manner of attachment of the fabric holder of FIGS. 4 and 5 to the side member at attachment location "X" when the fabric holder is in its fabric hooking position.

FIGS. 6 and 7 illustrate one location "X" found on each of the rack side members 11 and 12, and FIGS. 8 and 9 show one fabric holder 50 and the manner of attachment and use of the fabric holder relative to its attachment location X. As seen in FIGS. 6 and 7, the location X comprises a small block 110 or the like which extends upwardly parallel to the side member 12 and spaced therefrom and connected thereto by a relatively thin bridging member 114, the thickness of the bridging member 114 being the same as or slightly greater than the distance between the legs of the U-shaped central portion 55 of the fabric holder 50. As seen in FIGS. 8 and 9, the fabric holder 50 slips over the bridging member 114 and is tightly frictionally pinched by the legs of such U-shaped central portion 55 of the bridging member. The block 110, which can take various shapes, e.g. rectangular cross-section as shown in FIGS. 7A and 9A and circular cross-section as shown in FIGS. 7B and 9B, prevents the fabric holder 50 from sliding off laterally. The aforementioned pinching and the weight of the fabric prevent the fabric holder 50 from moving upwardly.

As indicated above, the rack of the present invention may be easily formed by injection molding of a suitable plastic to produce the blank 10. Any suitable plastic may be used which has sufficient rigidity and strength, such as polycarbonate, hard vinyl plastic, polyproplylene, etc. Conventional injection molding techniques may be used.

The rack so produced has numerous advantages as pointed out above, including excellent strength, low cost, durability, and the ability to recover and not become permanently deformed if it becomes bent during shipment. It is of light weight and thereby reduces the shipping costs of the fabric manufacturer. Being formed of plastic, there is no necessity for plating or painting, and staining or other damage to the fabric is avoided. Because of the internal supports, the rack of the present invention is not easily subjected to bending, and therefore a bolt of fabric suspended therefrom is not likely to bend or fold which could cause damage for some fabrics such as velvet which is susceptible to creasing. The various members of the rack are preferably formed with smooth edges, most preferably of round cross-section, and this insures that there are no sharp edges to snag the fabric.

In use, the molded blank is shipped directly to the fabric manufacturer who, upon receipt thereof, forms the fabric bolt hanger or rack as described above by disengaging the hanger hook 30 from its as molded position and inserting same through the opening 40, and by disengaging two of the fabric holders 50 from either location A or location B and affixing same to locations X. At this point, the assembled racks are ready for receipt of fabric. Consistent with conventional practice, fabric is woven with a selvage, i.e. a side edge portion which is not suitable for use. One end of a length of this fabric, of given selected width, is then hooked over one of the piercing hooks 53 of the fabric holder 50 at location X with the piercing hook extending through the selvage and the opposite side edge of the fabric extending parallel to the foot member 14 of the rack or hanger. The fabric is then wrapped transversely about the rack to form a bolt of fabric, the upper side edge selvage being hooked through a piercing hook 53 at both sides of the rack each time the fabric is passed thereabout. When sufficient length of fabric to form a bolt has been formed, the selvage at the trailing end is then hooked onto the closest piercing hook 53 and the bolt of fabric, e.g. velvet, is ready for shipment.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. For example, although the piercing hooks are preferably made of the same material as the rack and molded at the same time as pointed out above, it is also possible to mold the piercing hooks of another material which is harder, and it is also possible without departing from the invention that the piercing hooks be made separately such as from metal. It is to be understood that the phraseology or terminology herein is for the purpose of description and not of limitation.

What is claimed is:

1. A rack for bolts of fabric, comprising:

a molded plastic unitary frame structure having overall length and width dimensions of a size selected to accommodate the length and width dimensions of a bolt of fabric contemplated to be formed thereon and supported thereby, said unitary frame structure including outer perimeter slender members forming a generally rectangular support frame and including an upper shorter slender member and longer slender members, and secondary reinforcement members interconnected with one another and with said outer perimeters members, at least one of said reinforcement members having curvilinear portions, said members lying substantially in a plane, a hanger hook member interconnected with said upper shorter slender member of the frame structure, and fabric holders interconnected with the longer slender members of the frame structure at locations on the longer slender members adjacent said upper shorter slender member, each said fabric holder comprising:

a hook bar including a plurality of piercing hooks for attaching the fabric, said hook bar being disposed substantially perpendicular to the plane of said frame structure, whereby when said frame structure is suspended from a support by said hanger hook, said piercing hooks extend upwardly so that fabric can be wound about and supported on said frame structure while being secured to said frame structure by hooking engagement of said fabric with said piercing hooks.

2. The rack of claim 1, wherein said plastic is polycarbonate resin, polypropylene or rigid vinyl, and wherein said unitary frame structure, said hanger hook and said fabric holders are molded together in blank form.

3. A rack in accordance with claim 1, wherein at least some of said secondary reinforcement members are circular and lie within and tangentially touch said substantially rectangular support frame.

4. A rack according to claim 1, comprising interconnecting means for effecting said interconnection of each said fabric holder with one of said longer slender members of the frame structure, said interconnecting means comprising a blocking member connected to said longer slender member by a bridging member, and each said fabric holder comprises a member for cooperatively interengaging with said bridging member.

5. A rack according to claim 1, wherein said hook bar comprises a pair of coaxial sections separated by a U-shaped pinching member, said U-shaped pinching member tightly interengaging with a bridging member extending outwardly from said longer slender member, and blocking means adjacent said bridging members for preventing lateral movement of said fabric holder.

6. A molded plastic unitary blank for the manufacture of a rack for bolts of fabric, comprising:

a frame structure having overall length and width dimensions of a size selected to accommodate the length and width dimensions of a bolt of fabric contemplated to be formed on and supported by said rack, said frame structure including outer perimeter slender members forming a generally rectangular support frame and including upper shorter slender members and longer slender members and secondary reinforcement members interconnected with one another and with said outer perimeter members, at least one of said reinforcement members having curvilinear portions, a hanger hook member integrally molded within said generally rectangular support frame and connected to said frame structure by at least one first easily severable portion, and first connecting means along said upper one of the shorter slender members of the support frame structure for interconnecting said hanger hook member after removal of said hanger hook member from its initial molded position, and fabric holder connecting means at locations on the longer slender members adjacent the upper shorter slender members for interconnecting fabric holders to said longer slender members.

7. A molded plastic unitary blank according to claim 6 further comprising a plurality of fabric holders wherein said fabric holders being initially integrally molded within said generally rectangular support frame and connected to said frame section by second easily severable portions, each said fabric holder comprising a hook bar including a plurality of piercing hooks for attaching fabric thereto after removal of said fabric holders from their initial molded positions and placement thereof on said second connecting means.

8. A rack in accordance with claim 1 wherein said unitary frame structure and said hanger hook are molded together in blank form.

9. A rack in accordance with claim 1 wherein said plastic is polycarbonate resin, polypropylene or rigid vinyl, and wherein said unitary frame structure and said hanger hook are molded together in blank form.

* * * * *